US008434326B2

(12) United States Patent
Ambari et al.

(10) Patent No.: US 8,434,326 B2
(45) Date of Patent: May 7, 2013

(54) METHOD AND APPARATUS FOR LIQUEFYING A HYDROCARBON STREAM

(75) Inventors: Intan Agustina Ambari, The Hague (NL); Hsiao Teing Lee, The Hague (NL)

(73) Assignee: Shell Oil Company, Houston, TX (US)

( * ) Notice: Subject to any disclaimer, the term of this patent is extended or adjusted under 35 U.S.C. 154(b) by 1262 days.

(21) Appl. No.: 12/293,906

(22) PCT Filed: Mar. 16, 2007

(86) PCT No.: PCT/EP2007/052490

§ 371 (c)(1),
(2), (4) Date: Sep. 22, 2008

(87) PCT Pub. No.: WO2007/110331

PCT Pub. Date: Oct. 4, 2007

(65) Prior Publication Data

US 2009/0107174 A1 Apr. 30, 2009

(30) Foreign Application Priority Data

Mar. 24, 2006 (EP) ..... 06111666

(51) Int. Cl.
*F25J 3/00* (2006.01)

(52) U.S. Cl.
USPC ..... 62/621; 62/620; 62/618; 62/611

(58) Field of Classification Search ..... None
See application file for complete search history.

(56) References Cited

U.S. PATENT DOCUMENTS 4,617,039 A * 10/1986 Buck ..... 62/621
4,854,955 A 8/1989 Campbell et al. ..... 62/24

(Continued)

FOREIGN PATENT DOCUMENTS

DE 3639555 5/1988
GB 2415201 12/2005

OTHER PUBLICATIONS

Chiu C-H: "LPG-Recovery Processes for Baseload LNG Plants Examined" Oil and Gas Journal, Pennwell, Houston, Texas, US, Nov. 24, 1997, pp. 59-63, XP001093790. ISSN: 0030-1388, Figure 5.
International Search Report (PCT/EP2007/052490).

*Primary Examiner* — John Pettitt

(57) ABSTRACT

The present invention relates to a method of liquefying a hydrocarbon stream such as a natural gas stream, the method at least comprising the steps of: supplying a partly condensed feed stream (10) having a pressure above 60 bar to a first separator (2) wherein it is separated into a gaseous stream (20) and a liquid stream (30); expanding the liquid stream (30) and the gaseous stream (20) and subsequently feeding them into the distillation column (3); removing from the distillation column (3) a gaseous overhead stream (80), partially condensing it, feeding it (90) into a second separator (8) thereby obtaining a liquid stream (100) and a gaseous stream (110), feeding the liquid stream (100) into the distillation column (3) and liquefying the gaseous stream (110) thereby obtaining a liquefied stream (200); wherein the gaseous overhead stream (80) is partially condensed by heat exchanging against the expanded gaseous stream (60) before it (70) is fed into the distillation column (3); and wherein the gaseous stream (110) is removed from the second separator but before it (160) is liquefied, is heat exchanged against the feed stream (10*a*), thereby partially condensing the feed stream (10*a*).

22 Claims, 2 Drawing Sheets

U.S. PATENT DOCUMENTS

| | | | | |
|---|---|---|---|---|
| 4,869,740 | A * | 9/1989 | Campbell et al. | 62/621 |
| 5,983,664 | A * | 11/1999 | Campbell et al. | 62/621 |
| 6,023,942 | A * | 2/2000 | Thomas et al. | 62/613 |
| 6,370,910 | B1 | 4/2002 | Grootjans et al. | 62/613 |
| 6,389,844 | B1 | 5/2002 | Voort | 62/612 |
| 6,526,777 | B1 * | 3/2003 | Campbell et al. | 62/621 |
| 2002/0065446 | A1 * | 5/2002 | Wilkinson et al. | 585/802 |
| 2002/0095062 | A1 | 7/2002 | Paradowski | 585/802 |
| 2004/0079107 | A1 * | 4/2004 | Wilkinson et al. | 62/611 |
| 2005/0268649 | A1 * | 12/2005 | Wilkinson et al. | 62/613 |

* cited by examiner

METHOD AND APPARATUS FOR LIQUEFYING A HYDROCARBON STREAM

The present application claims priority from European Patent Application 06111666.1 filed 24 Mar. 2006.

FIELD OF THE INVENTION

The present invention relates to a method of liquefying a hydrocarbon stream such as a natural gas stream, thereby obtaining a liquefied hydrocarbon product such as liquefied natural gas (LNG).

BACKGROUND OF THE INVENTION

Several methods of liquefying a natural gas stream thereby obtaining LNG are known. It is desirable to liquefy a natural gas stream for a number of reasons. As an example, natural gas can be stored and transported over long distances more readily as a liquid than in gaseous form, because it occupies a smaller volume and does not need to be stored at high pressures.

Usually, the natural gas stream to be liquefied (mainly comprising methane) contains ethane, heavier hydrocarbons and possibly other components that are to be removed to a certain extent before the natural gas is liquefied. To this end, the natural gas stream is treated. One of the treatments involves the removal of at least some of the ethane, propane and higher hydrocarbons such as butane and propane.

US 2004/0079107 A1 discloses a process for liquefying natural gas in conjunction with producing a liquid stream containing predominantly hydrocarbons heavier than methane.

A problem of the method disclosed in US 2004/0079107 A1 is that it is rather complicated resulting in relatively high capital expenses (CAPEX). As an example, FIG. 1 of US 2004/0079107 A1 makes use of an intermediate refrigerant cycle 71, thereby relying heavily on external refrigeration. Furthermore the fractionation tower 19 comprises one or more reboilers 20 near the bottom of the tower 19 which heat and vaporize a portion of the liquids flowing down the tower 19 to provide the stripping vapors which flow up the tower 19.

SUMMARY OF THE INVENTION

It is an object of the invention to minimize the above problem, while at the same time maintaining or even improving the recovery of ethane and heavier hydrocarbons, in particular propane, from the hydrocarbon stream.

It is a further object of the present invention to provide an alternative method for liquefying a hydrocarbon stream, whilst at the same time recovering at least some of the ethane, propane and higher hydrocarbons such as butane and propane, in particular propane.

One or more of the above or other objects are achieved according to the present invention by providing a method of liquefying a hydrocarbon stream such as a natural gas stream, the method at least comprising the steps of:

(a) supplying a partly condensed feed stream having a pressure above 60 bar to a first gas/liquid separator;

(b) separating the feed stream in the first gas/liquid separator into a gaseous stream and a liquid stream;

(c) expanding the liquid stream obtained in step (b) and feeding it into a distillation column at a first feeding point;

(d) expanding the gaseous stream obtained in step (b), thereby obtaining an at least partially condensed stream, and subsequently feeding it into the distillation column at a second feeding point, the second feeding point being at a higher level than the first feeding point;

(e) removing from the top of the distillation column a gaseous overhead stream, partially condensing it and feeding it into a second gas/liquid separator;

(f) separating the stream fed in the second gas/liquid separator in step (e) thereby obtaining a liquid stream and a gaseous stream;

(g) feeding the liquid stream obtained in step (f) into the distillation column at a third feeding point, the third feeding point being at a higher level than the second feeding point; and (h) liquefying the gaseous stream obtained in step (f) thereby obtaining a liquefied stream;

wherein the gaseous overhead stream removed from the distillation column in step (e) is partially condensed by heat exchanging against the stream expanded in step (d) before it is fed into the distillation column at the second feeding point; and wherein the gaseous stream obtained in step (f) is heat exchanged against the feed stream of step (a) before it is liquefied in step (h), thereby partially condensing the feed stream.

BRIEF DESCRIPTION OF THE DRAWINGS

Hereinafter the invention will be further illustrated by the following non-limiting drawing. Herein shows.

DETAILED DESCRIPTION OF THE INVENTION

Figure 1:
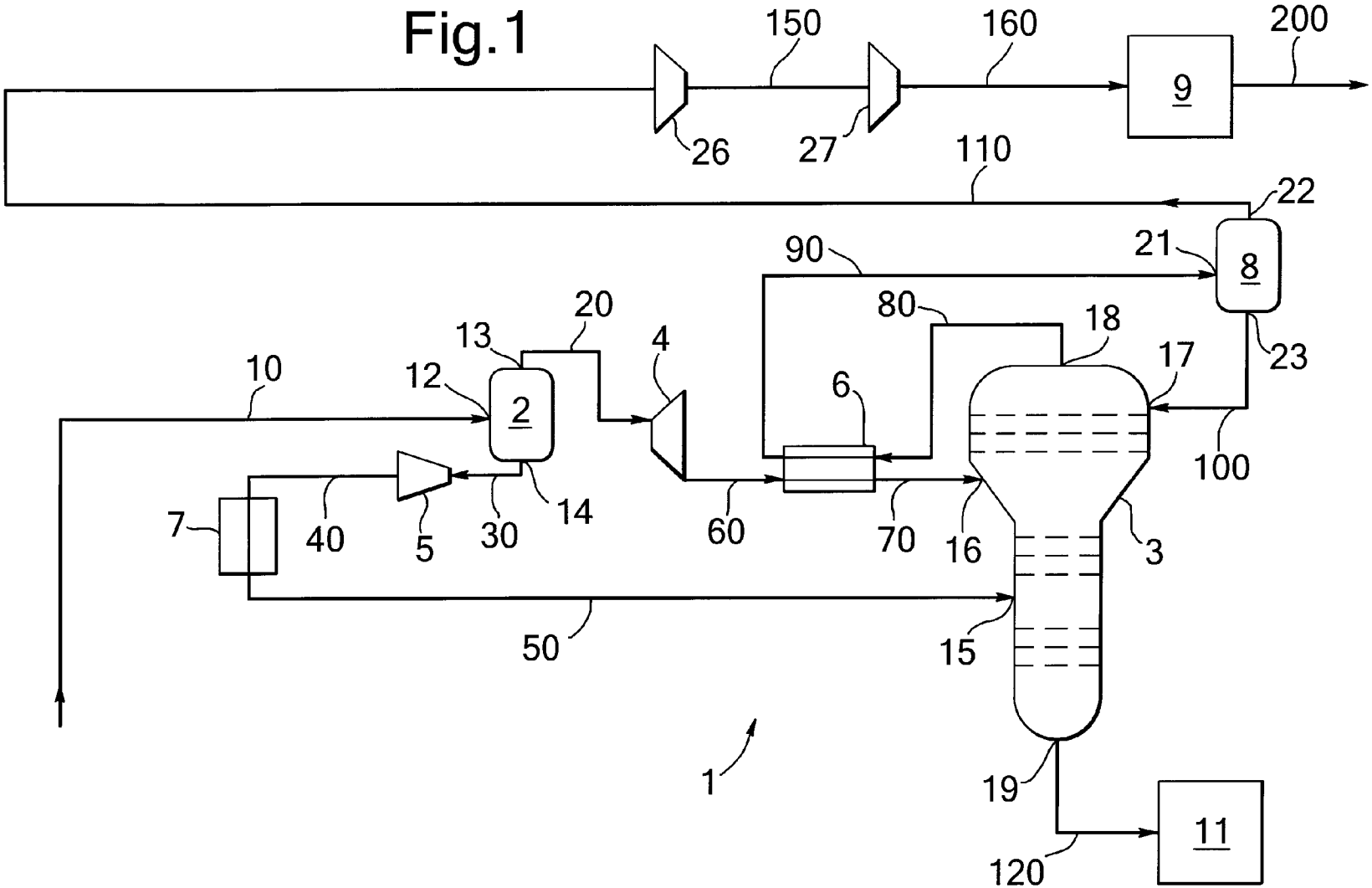
FIG. 1 schematically a process scheme for liquefying natural gas, incorporated for illustration purposes.

It has been found that using the surprisingly simple method according to the present invention, the CAPEX can be significantly lowered. Further, also due to its simplicity, the method according to the present invention and apparatuses for performing the method have proven very robust when compared with known line-ups.

Further it has been found that by heat exchanging the gaseous stream obtained in step (f) against the feed stream of step (a) before it is liquefied in step (h), thereby partially condensing the feed stream, a higher process efficiency can be obtained.

An important advantage of the present invention is that no external refrigerant cycle is needed to cool the feed stream. Also, the duty of the reboiler (if any) used near the bottom of the distillation column can be minimized. According to the present invention it is even preferred that no reboiler is present near the bottom of the distillation column for heating and vaporizing a portion of the liquids flowing down the distillation column to provide stripping vapors which flow up the distillation column.

Furthermore it has been found that according to the present invention a higher propane recovery can be obtained thereby resulting in a leaner methane-rich natural gas stream (that is liquefied subsequently). The method according to the present invention has also been proven suitable for feed streams having a pressure well below 70 bar, at the same time keeping up a relatively high propane recovery.

Another advantage of the present invention is that it is suitable for a broad range of feed stream compositions.

In this respect it is noted that there are several publications relating to the recovery of ethane and heavier hydrocarbon components from a hydrocarbon stream as such, without at the same time aiming for the liquefaction of the (preferably methane-enriched) hydrocarbon stream. Examples of these publications are U.S. Pat. No. 4,869,740, U.S. Pat. No. 4,854,955, GB 2 415 201, US 2002/0095062 and DE 36 39 555. However, the person skilled in the art readily understands that if ethane and heavier hydrocarbon components are to be removed from a (preferably methane-enriched) hydrocarbon stream that is to be liquefied eventually, this results—in view of efficiency considerations—in certain amendments to the recovery unit being placed upstream of the liquefaction unit. In other words, recommendations given in publications only dealing with the recovery of ethane and heavier hydrocarbon components from a hydrocarbon stream as such, without at the same time aiming for the liquefaction of the (preferably methane-enriched) hydrocarbon stream, are not automatically also valid for line-ups in which both recovery (of ethane and heavier hydrocarbon components) and liquefaction (of the preferably methane-enriched) hydrocarbon stream takes place.

According to the present invention, the hydrocarbon stream to may be any suitable hydrocarbon-containing stream to be liquefied eventually, but is usually a natural gas stream obtained from natural gas or petroleum reservoirs. As an alternative the natural gas stream may also be obtained from another source, also including a synthetic source such as a Fischer-Tropsch process.

Usually the hydrocarbon stream is comprised substantially of methane. Preferably the feed stream comprises at least 60 mol % methane, more preferably at least 80 mol % methane.

Depending on the source, the hydrocarbon stream may contain varying amounts of hydrocarbons heavier than methane such as ethane, propane, butanes and pentanes as well as some aromatic hydrocarbons. The hydrocarbon stream may also contain non-hydrocarbons such as $H_2O$, $N_2$, $CO_2$, $H_2S$ and other sulphur compounds, and the like.

If desired, the feed stream may be pre-treated before feeding it to the first gas/liquid separator. This pre-treatment may comprise removal of undesired components such as $CO_2$ and $H_2S$, or other steps such as pre-cooling, pre-pressurizing or the like. As these steps are well known to the person skilled in the art, they are not further discussed here.

The first and second gas/liquid separator may be any suitable means for obtaining a gaseous stream and a liquid stream, such as a scrubber, distillation column, etc. If desired, three or more gas/liquid separators may be present.

Also, the person skilled in the art will understand that the steps of expanding may be performed in various ways using any expansion device (e.g. using a flash valve or a common expander).

The distillation column is preferably a so-called de-ethanizer, i.e. wherein the overhead stream(s) removed form the distillation column is (are) enriched in ethane when compared with the stream(s) fed to the distillation column.

Although the method according to the present invention is applicable to various hydrocarbon feed streams, it is particularly suitable for natural gas streams to be liquefied. As the person skilled readily understands how to liquefy a hydrocarbon stream, this is not further discussed here. Examples of liquefaction processes are given in U.S. Pat. No. 6,389,844 and U.S. Pat. No. 6,370,910, the content of which is hereby incorporated by reference.

Further the person skilled in the art will readily understand that after liquefaction, the liquefied natural gas may be further processed, if desired. As an example, the obtained LNG may be depressurised by means of a Joule-Thomson valve or by means of a cryogenic turbo-expander. Also, further intermediate processing steps between the gas/liquid separation in the first gas/liquid separator and the liquefaction may be performed.

In a further aspect the present invention relates to an apparatus suitable for performing the method according to the present invention, the apparatus at least comprising:

a first gas/liquid separator having an inlet for a partly condensed feed stream having a pressure above 60 bar, a first outlet for a gaseous stream and a second outlet for a liquid stream;

a distillation column having at least a first outlet for a gaseous stream and a second outlet for a liquid stream and first, second and third feeding points;

a first expander for expanding the gaseous stream obtained from the first outlet of the first gas/liquid separator;

a second expander for expanding the liquid stream obtained from the second outlet of the first gas/liquid separator;

a first heat exchanger between the first expander and the second feeding point of the distillation column;

a second gas/liquid separator having an inlet for the stream obtained at the first outlet of the distillation column, a first outlet for a gaseous stream and a second outlet for a liquid stream, the second outlet being connected to the third feeding point of the distillation column;

a liquefaction unit for liquefying the gaseous stream obtained at the first outlet of the second gas/liquid separator, the liquefaction unit comprising at least one cryogenic heat exchanger; and a further heat exchanger for heat exchanging the gaseous stream obtained at the first outlet of the second gas/liquid separator against the feed stream, before it is liquefied in the liquefaction unit;

wherein the first heat exchanger is placed between the first outlet of the distillation column and the inlet of the second gas/liquid separator.

Figure 2:
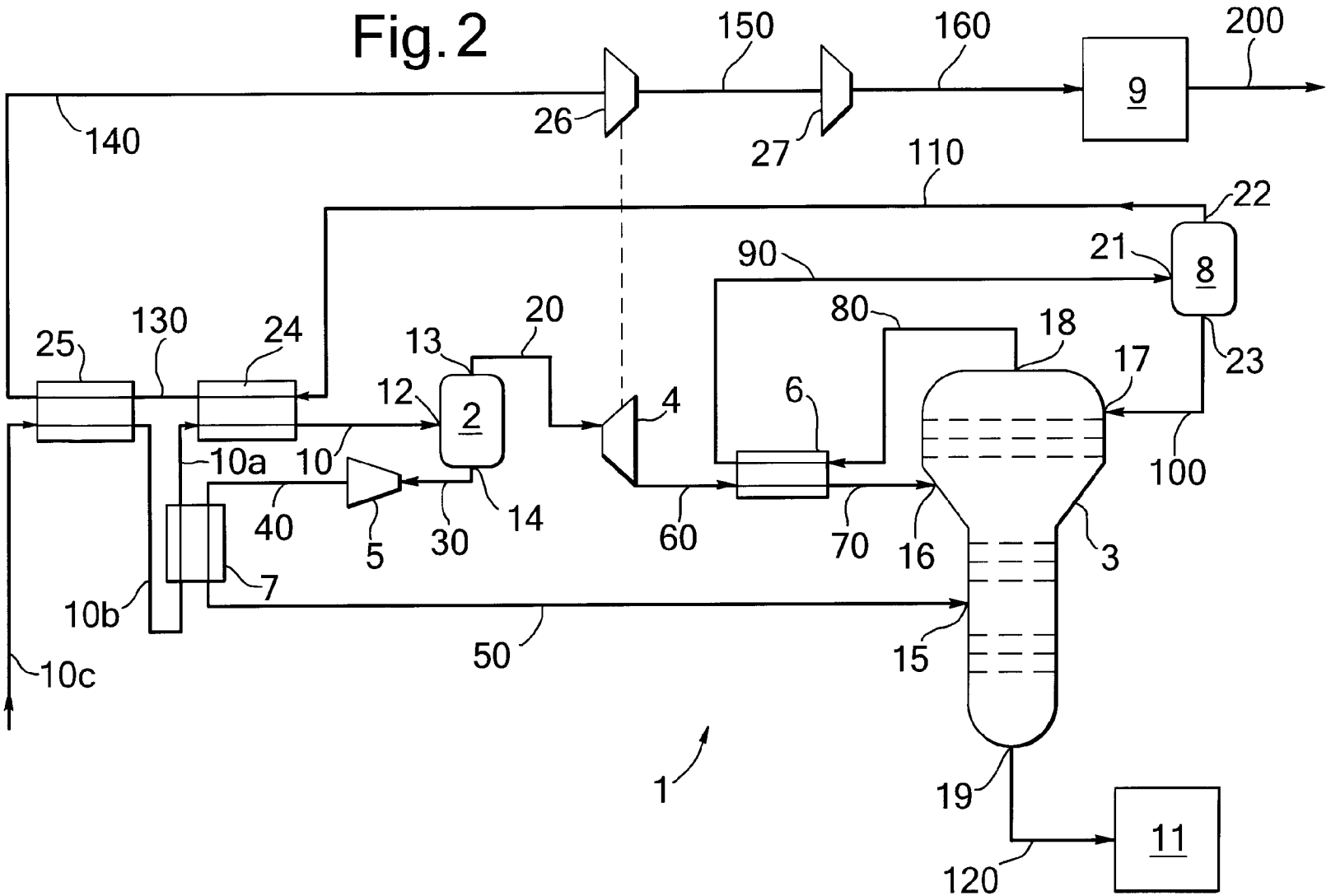
FIG. 2 schematically a process scheme in accordance with the present invention.

Hereinafter the invention will be further illustrated by the following non-limiting drawing. Herein shows:

FIG. 1 schematically a process scheme for liquefying natural gas, incorporated for illustration purposes; and FIG. 2 schematically a process scheme in accordance with the present invention.

For the purpose of this description, a single reference number will be assigned to a line as well as a stream carried in that line. Same reference numbers refer to similar components.

FIG. 1 schematically shows a process scheme (generally indicated with reference no. 1) for the liquefaction of a hydrocarbon stream such as natural gas in which the hydrocarbon stream is previously treated whereby propane and heavier hydrocarbons are removed to a certain extent before the actual liquefaction takes place.

The process scheme of FIG. 1 comprises a first gas/liquid separator 2, a distillation column 3 (preferably a de-ethanizer), a first expander 4, a second expander 5, a first heat exchanger 6, a second heat exchanger 7, a second gas/liquid separator 8, a liquefaction unit 9 and a fractionation unit 11. The person skilled in the art will readily understand that further elements may be present if desired.

During use, a partly condensed feed stream 10 containing natural gas is supplied to the inlet 12 of the first gas/liquid separator 2 at a certain inlet pressure and inlet temperature. Typically, the inlet pressure to the first gas/liquid separator 2 will be between 10 and 100 bar, preferably above 40 bar, more preferably above 60 bar and preferably below 90 bar, more preferably below 70 bar. The temperature will usually between 0 and −60° C., preferably colder than −35° C. To obtain the partly condensed feed stream 10, it may have been pre-cooled in several ways, a preferred embodiment being shown in FIG. 2.

If desired the feed stream 10 may have been further pre-treated before it is fed to the first gas/liquid separator 2. As an example, $CO_2$, $H_2S$ and hydrocarbon components having the molecular weight of pentane or higher may also at least partially have been removed from the feed stream 10 before entering the separator 2. In this respect it is noted that the apparatus 1 according to FIG. 1 has a high tolerance to $CO_2$, as a result of which it is not necessary to remove the $CO_2$ if no liquefaction takes place in the liquefaction unit 9 after the treating.

In the first gas/liquid separator 2, the feed stream 10 is separated into a gaseous overhead stream 20 (removed at first outlet 13) and a liquid bottom stream 30 (removed at second outlet 14). The overhead stream 20 is enriched in methane (and usually also ethane) relative to the feed stream 10.

The bottom stream 30 is generally liquid and usually contains some components that are freezable when they would be brought to a temperature at which methane is liquefied. The bottom stream 30 may also contain hydrocarbons that can be separately processed to form liquefied petroleum gas (LPG) products. The stream 30 is expanded in the second expander 5 and preferably heated in second heat exchanger 7 and fed into the distillation column 3 at the first feeding point 15 as stream 50. If desired second heat exchanger 7 can be dispensed with. The person skilled in the art will understand that second heat exchanger 7 as used in FIG. 1 may be any heat exchanger for heat exchanging against any other process line (including an external refrigerant stream). The second expander 5 may be any expansion device such as an common expander as well as a flash valve.

The gaseous overhead stream 20 removed at the first outlet 13 of the first separator 2 is at least partially condensed in the first heat exchanger 6 and subsequently fed as stream 70 into the distillation column 3 at a second feeding point 16, the second feeding point 16 being at a higher level than the first feeding point 15.

From the top of the distillation column 3, at first outlet 18, a gaseous overhead stream 80 is removed that is partially condensed in first heat exchanger 6 while heat exchanging it against stream 60, and is fed into second gas/liquid separator 8 as stream 90.

The stream 90 being fed into the second gas/liquid separator 8 at inlet 21 is separated thereby obtaining a liquid stream 100 (at second outlet 23) and a gaseous stream 110 (at first outlet 22).

The liquid stream 100 removed at second outlet 23 is fed into the distillation column 3 at a third feeding point 17, the third feeding point 17 being at a higher level than the second feeding point 16.

The gaseous stream 110 obtained at the first outlet 22 of the second gas/liquid separator 8 is forwarded to the liquefaction unit 9 comprising at least one cryogenic heat exchanger (not shown) to produce liquefied natural gas (LNG) stream 200. If desired, the stream 110 may be subjected to further process steps before liquefaction takes place in the liquefaction unit 9.

An advantage of FIG. 1 is that the gaseous overhead stream 80 removed from the distillation column 3 is partially condensed in the first heat exchanger 6 by heat exchanging against the stream 60 expanded in first expander 4 before it (stream 70) is fed into the distillation column 3 at the second feeding point 16.

Preferably, stream 20 is not cooled before it is expanded in the first expander 4, i.e. between the first outlet 13 of the first gas/liquid separator 2 and the first expander 4 no cooler (such as an air cooler, water cooler, heat exchanger, etc.) is present.

Usually, a liquid bottom stream 120 is removed from the second outlet 19 of the distillation column and is subjected to one or more fractionation steps in a fractionation unit 11 to collect various natural gas liquid products. As the person skilled in the art knows how to perform fractionation steps, this is not further discussed here.

FIG. 2 schematically shows an embodiment according the present invention, wherein a preferred way of pre-cooling the natural gas stream 10*c* is shown thereby obtaining the partly condensed feed stream 10 as meant in FIG. 1. The recommendations as made for the embodiment of FIG. 1 are also applicable to the embodiment of FIG. 2.

According to the embodiment of FIG. 2, the process scheme further comprises a third heat exchanger 24 and a fourth heat exchanger 25. Furthermore, first and second compressors 26 and 27 (also shown in FIG. 1) are present just upstream of the liquefaction unit 9 for increasing the pressure of the stream 110 to be liquefied to above 50, preferably above 70 bar. Of course, further heat exchangers, expanders, compressors, etc. may be present.

The feed stream 10*c* is successively heat exchanged in fourth heat exchanger 25 against stream 130, in second heat exchanger 7 against stream 40 and in third heat exchanger 24 against stream 110. If desired, a further heat exchanger (not shown) may be present on line 10*b* (between fourth heat exchanger 25 and second heat exchanger 7) in which an external refrigerant (such as e.g. propane) is used to cool the feed stream. It goes without saying that one or more of the second, third and fourth heat exchangers 7, 24 and 25 may be replaced by heat exchangers in which an external refrigerant is used. However, in the heat exchangers 24 and 25 preferably direct heat exchange takes place between the stream 110 and streams 10*c* and 10*a*, respectively, i.e. without using an intermediate refrigerant cycle or the like.

After having been heat exchanged against stream 10*a* (in third heat exchanger 24) and 10*c* (in fourth heat exchanger 25), stream 110 is compressed in the above first and second compressors 26 and 27, as streams 140 and 150 respectively. First compressor 26 is functionally coupled to first expander 4.

An advantage of the use of (one or more) the heat exchangers 24 and 25 is that the duty of a reboiler used at the bottom of the distillation column 3 (cf. reboiler 20 in FIG. 1 of US 2004/0079107 A1) can be minimized. Preferably, and as shown in FIG. 2, according to the present invention no reboiler is present at or near the bottom of the distillation column 3.

Table I gives an overview of the pressures and temperatures of a stream at various parts in an example process of FIG. 2. Also the mol % of methane is indicated. The feed stream in line 10*c* of FIG. 2 comprised approximately the following composition: 88% methane, 6% ethane, 2% propane, 1% butanes and pentane and 3% $N_2$. Other components such as $H_2S$, $CO_2$ and $H_2O$ were previously removed.

TABLE I

| Line | Pressure (bar) | Temperature (° C.) | Mol. % methane |
|---|---|---|---|
| 10c | 65.7 | 20.6 | 87.7 |
| 10b | 65.4 | −3.0 | 87.7 |
| 10a | 65.0 | −10.9 | 87.7 |
| 10 | 64.7 | −48.0 | 87.7 |
| 20 | 64.6 | −48.1 | 90.0 |
| 50 | 28.3 | −18.5 | 61.0 |

TABLE I-continued

| Line | Pressure (bar) | Temperature (° C.) | Mol. % methane |
|---|---|---|---|
| 60 | 28.5 | −83 | 90.0 |
| 70 | 28.1 | −75 | 90.0 |
| 80 | 27.8 | −72.1 | 88.9 |
| 100 | 27.3 | −78.5 | 55.9 |
| 110 | 27.3 | −78.5 | 90.7 |
| 120 | 28.0 | 97.8 | 0.0 |
| 130 | 27.0 | −12.7 | 90.7 |
| 140 | 26.6 | 19.0 | 90.7 |
| 150 | 32.3 | 68.0 | 90.7 |
| 160 | 93.4 | 174.4 | 90.7 |

As a comparison the same line-up as FIG. 2 was used, but—in contrast to the present invention—no heat exchanging took place in the first heat exchanger 6. It was found that according to the present invention a significantly higher propane recovery was obtained in stream 120, as is shown in Table II. Further calculations showed that the propane recovery (in %) was as high as 98% according to the invention, whilst the line-up without the heat exchanger 6 resulted in a propane recovery of only 82%.

TABLE II

| Component | Molar composition of stream 10c in FIG. 2 | Molar composition of stream 120 in FIG. 2 (present invention) | Molar composition of stream 120 in FIG. 2 without heat exchanging in heat exchanger 6 (comparison) |
|---|---|---|---|
| Flow rate [kmol/s] | 12.61 | 0.42 | 0.38 |
| Methane | 0.877 | 0.000 | 0.000 |
| Ethane | 0.056 | 0.010 | 0.011 |
| Propane | 0.020 | 0.584 | 0.547 |
| i-Butane | 0.003 | 0.104 | 0.111 |
| Butane | 0.005 | 0.159 | 0.173 |
| i-Pentane | 0.002 | 0.048 | 0.053 |
| Pentane | 0.001 | 0.042 | 0.046 |

The person skilled in the art will readily understand that many modifications may be made without departing from the scope of the invention. As an example, the compressors may comprise two or more compression stages. Further, each heat exchanger may comprise a train of heat exchangers.

What is claimed is:

1. A method of liquefying a hydrocarbon stream comprising the steps of:

(a) supplying a partly condensed feed stream having a pressure above 60 bar to a first gas/liquid separator;

(b) separating the feed stream in the first gas/liquid separator into a first gaseous stream, which first gaseous stream is removed from the first gas/liquid separator at a first outlet, and a first liquid stream;

(c) expanding the first liquid stream obtained in step (b) thereby forming an expanded first liquid stream, and feeding the expanded first liquid stream into a distillation column at a first feeding point;

(d) expanding all of the first gaseous stream removed at the first outlet of the first gas/liquid separator in step (b), thereby obtaining an expanded gaseous stream which is at least partially condensed, and subsequently feeding all of the expanded gaseous stream into the distillation column at a second feeding point, the second feeding point being at a higher level than the first feeding point;

(e) removing from the top of the distillation column a second gaseous stream, partially condensing the second gaseous stream thereby forming a partially condensed second gaseous stream, and feeding the partially condensed second gaseous stream into a second gas/liquid separator;

(f) separating the stream fed in the second gas/liquid separator in step (e) thereby obtaining a second liquid stream and a third gaseous stream;

(g) feeding the second liquid stream obtained in step (f) into the distillation column at a third feeding point, the third feeding point being at a higher level than the second feeding point; and (h) liquefying the third gaseous stream obtained in step (f) thereby obtaining a liquefied stream;

wherein the second gaseous stream removed from the distillation column in step (e) is partially condensed by heat exchanging against all of the expanded gaseous stream before the expanded gaseous stream is fed into the distillation column at the second feeding point; and wherein the third gaseous stream obtained in step (f) is heat exchanged against the feed stream of step (a) before the third gaseous stream is liquefied in step (h), thereby partially condensing the feed stream.

2. The method according to claim 1, wherein the first gaseous stream obtained in step (b) is not cooled before said expanding in step (d).

3. The method according to claim 1, wherein the first liquid stream obtained in step (b) is heat exchanged against the feed stream before the feed stream is fed into the first gas/liquid separator in step (a).

4. The method according to claim 1, wherein the pressure of the third gaseous stream obtained in step (f), is increased to a pressure of at least 70 bar, before said liquefying in step (h).

5. The method according to claim 1, wherein a third liquid stream is removed from the bottom of the distillation column, which third liquid stream is subjected to further fractionation.

6. The method according to claim 1, wherein the third gaseous stream is heat exchanged against the feed stream of step (a) without using an intermediate refrigerant cycle.

7. The method according to claim 1, wherein the partly condensed feed stream as supplied in step (a) has a temperature of below −35° C.

8. An apparatus for liquefying a hydrocarbon stream comprising:

a first gas/liquid separator having an inlet for a partly condensed feed stream having a pressure above 60 bar, a first outlet for a first gaseous stream and a second outlet for a first liquid stream;

a distillation column having at least a first outlet for a second gaseous stream and a second outlet for a second liquid stream and first, second and third feeding points, the third feeding point being at a higher level than the second feeding point and the second feeding point being at a higher level than the first feeding point;

a first expander for expanding all of the first gaseous stream obtained from the first outlet of the first gas/liquid separator;

a second expander between the second outlet of the first gas/liquid separator and the first feeding point of the distillation column, for expanding the first liquid stream obtained from the second outlet of the first gas/liquid separator;

a first heat exchanger between the first expander and the second feeding point of the distillation column, arranged to receive all of the expanded gaseous stream from the first expander;

a second gas/liquid separator having an inlet for the second gaseous stream obtained at the first outlet of the distillation column, a first outlet for a third gaseous stream and a second outlet for a third liquid stream, the second outlet being connected to the third feeding point of the distillation column;

a liquefaction unit for liquefying the third gaseous stream obtained at the first outlet of the second gas/liquid separator, the liquefaction unit comprising at least one cryogenic heat exchanger; and a further heat exchanger for heat exchanging the third gaseous stream obtained at the first outlet of the second gas/liquid separator against the feed stream, before the third gaseous stream is liquefied in the liquefaction unit;

wherein the first heat exchanger is placed between the first outlet of the distillation column and the inlet of the second gas/liquid separator.

9. The apparatus according to claim 8, wherein between the first outlet of the first gas/liquid separator and the first expander no cooler is present.

10. The apparatus according to claim 8, comprising a second heat exchanger between the second expander and the first feeding point of the distillation column.

11. The apparatus according to claim 10, wherein the feed stream can be cooled in the second heat exchanger against the first liquid stream obtained from the second outlet of the first gas/liquid separator.

12. The apparatus according to claim 10, wherein the further heat exchanger comprises a third heat exchanger between the second heat exchanger and the first inlet of the first gas/liquid separator in which the third gaseous stream obtained at the first outlet of the second gas/liquid separator can be heat exchanged against the feed stream.

13. The apparatus according to claim 12, wherein the further heat exchanger comprises a fourth heat exchanger upstream of the second heat exchanger in which the third gaseous stream obtained at the first outlet of the second gas/liquid separator, after being heat exchanged in the third heat exchanger, can be further heat exchanged against the feed stream.

14. The apparatus according to claim 8, wherein the second outlet of the distillation column is connected to a fractionation unit.

15. The method according to claim 2, wherein the first liquid stream obtained in step (b) is heat exchanged against the feed stream before the feed stream is fed into the first gas/liquid separator in step (a).

16. The method according to claim 1, wherein the pressure of the third gaseous stream obtained in step (f) is increased to a pressure of at least 84 bar, before said liquefying in step (h).

17. The method according to claim 1, wherein the pressure of the third gaseous stream obtained in step (f) is increased to a pressure of at least 86 bar, before said liquefying in step (h).

18. The method according to claim 1, wherein the pressure of the third gaseous stream obtained in step (f) is increased to a pressure of at least 90 bar, before said liquefying in step (h).

19. The apparatus according to claim 8, wherein no reboiler is present.

20. The apparatus according to claim 8, wherein no external refrigerant cycle is present to cool the feed stream.

21. The method according to claim 1, wherein no reboiler heats or vaporizes any portion of liquids flowing down the distillation column.

22. The method according to claim 1, wherein supplying the feed stream to the first gas/liquid separator occurs without cooling the feed stream via external refrigerant cycle.

* * * * *